United States Patent [19]

Scherrer et al.

[11] 4,153,378

[45] May 8, 1979

[54] RE-INKING AND VENTILATION CONTROL FOR INKED RIBBON CASSETTE

[75] Inventors: Herbert Scherrer, Pfäffikon; Ernst Bopp; Ennio Cecchetto, both of Zürich, all of Switzerland

[73] Assignee: Franz Büttner AG., Zürich, Switzerland

[21] Appl. No.: 774,894

[22] Filed: Mar. 7, 1977

Related U.S. Application Data

[63] Continuation-in-part of Ser. No. 672,127, Mar. 31, 1976, Pat. No. 4,071,133.

[30] Foreign Application Priority Data

Nov. 18, 1975 [DE] Fed. Rep. of Germany ..... 2551677

[51] Int. Cl.[2] ..... B41J 33/14

[52] U.S. Cl. ..... 400/196.1; 400/200; 400/202.2

[58] Field of Search ..... 197/151, 168, 171

[56] References Cited

U.S. PATENT DOCUMENTS

| | | | |
|---|---|---|---|
| 1,414,865 | 5/1922 | Delbare | 197/171 |
| 2,732,824 | 1/1956 | Brown | 197/171 UX |
| 2,910,960 | 11/1959 | Markes | 197/171 X |
| 3,254,624 | 6/1966 | Besenick | 197/171 X |
| 3,400,801 | 9/1968 | Swenson | 197/171 |
| 3,904,015 | 9/1975 | Boyden et al. | 197/151 |
| 3,951,253 | 4/1976 | Tibay et al. | 197/171 |

*Primary Examiner*—Ernest T. Wright, Jr.
*Attorney, Agent, or Firm*—Ernest F. Marmorek

[57] ABSTRACT

The invention relates to a cassette for use in connection with a device for printing characters on a surface from the stroke impact of a dye impregnated ribbon such as a typewriter, and features a housing defining an aperture for ventilating a chamber defined therein, re-impregnating means disposed in the chamber and operable for re-impregnating the ribbon dye, and locking means removably engaged with the aperture and operable to activate the re-impregnating means during disengagement of the locking means with the aperture.

4 Claims, 15 Drawing Figures

RE-INKING AND VENTILATION CONTROL FOR INKED RIBBON CASSETTE

REFERENCE TO RELATED APPLICATION

This is a continuation-in-part application of the patent application Ser. No. 672,127, filed on Mar. 31, 1976 now U.S. Pat. No. 4,071,133, issued Jan. 31, 1978.

Generally, cassettes using an endless typewriter ribbon for typewriters, are in common use. Within the cassette, transport means are provided to move the ribbon in correspondence with the typing process and to retain the ribbon substantially stretched in the stroke region of the typewriter. The length of the ribbon is selected to provide an opportunity to re-impregnate the ribbon before each part of it is typed on at a subsequent time. This, of course, extends the useful life of the ribbon.

Generally, it is estimated that an ordinary textile typewriter ribbon having a width of about 6.35 mm and a length of about 13 m can be used to legibly print about 600,000 to 800,000 characters at a typing rate of about 30 characters per second. Based on this, such a ribbon is completely used up over a period of about 8 hours, about a normal working day. A careful study indicates that the time for re-impregnating the typing region of the ribbon is usually not sufficient so that the actual performance is not as good as the estimated performance.

One prior attempt to improve the useful life of the cassette ribbon utilizes inking rollers along the path of the ribbon within the typewriter. It has been determined that without the use of pressure or centrifugal force, very little ink is communicated from the inking rollers to the ribbon in contact therewith.

Another prior art attempt to overcome the problem utilizes a sponge saturated with ink and disposed within the cassette in contact with the ribbon. This embodiment did not use any storage area for the ribbon and relies on the continuous contact of the ribbon with the sponge to achieve re-impregnating of the ribbon. The results obtained have been unsatisfactory.

Generally, the re-impregnating of a ribbon with a dye during the typing use of the ribbon presents some difficulty because the stroke impact compresses the ribbon during the typing process and thereby disturbs the physical properties of the ribbon in the vicinity of the impact region.

Another problem especially associated with the endless ribbon type of cassette arises because the device for re-impregnating the ribbon remains in contact with the ribbon even during the storage period, before the cassette is placed into use. The capillary effect within the structure of the ribbon allows the ribbon to become saturated at least in the region where the re-impregnating device is in contact with the ribbon.

Another problem associated with the cassettes is the necessity to provide an aperture in order to ventilate the re-impregnating device with the ambient atmosphere so that the supply of the dye from the re-impregnating device will not be attenuated or possibly terminated due to the loss of gas pressure within the cassette as the dye is removed. The presence of an air hole presents the problem of the entry of undesired particles or liquids into the cassette or even the accidental loss of the dye out through the vent.

The necessity for a vent can be eliminated by the use of a cassette containing a gas under pressure. This solution, however, presents serious economic problems and is, therefore, not considered desirable.

SUMMARY OF THE INVENTION

One of the principal objects of the invention is a cassette, for use in connection with a device for printing characters on a surface from the stroke impact of an endless dye impregnated ribbon such as a typewriter, the device defining a stroke region, including a housing defining two chambers, one of the chambers providing a storage region, the housing having a passageway for the ribbon, the passageway intercommunicating with the storage region and being adapted to communicate with the stroke region, the ribbon being adapted to move between the stroke area and the storage region, re-impregnating means disposed in the other chamber and operable for impregnating the ribbon with dye; and transport means disposed substantially between the chambers and the passageway and operable for transporting the ribbon and for maintaining the ribbon substantially stretched in the stroke region.

Another embodiment of the invention further includes re-impregnating means including a capillary writing device such as a writing felt tip.

Another embodiment of the invention further includes the re-impregnating means including a forked member for re-impregnating the portions of the ribbon adjacent to the area of the stroke impact of the ribbon.

Another embodiment of the invention further includes the re-impregnating means including a plurality of rollers aligned in the fashion of a multi-roller-printing machine for carrying the dye onto the ribbon.

Another principal object of the invention is a cassette, for use in connection with a device for printing characters on a surface from the stroke impact of a dye impregnated ribbon such as a typewriter, including a housing defining an aperture for ventilating a chamber defined therein, re-impregnating means disposed in the chamber operable for re-impregnating the ribbon with dye, and locking means removably engaged with the aperture and operable to inactivate the re-impregnating means during engagement of the locking means with the aperture.

Further objects and advantages of the invention will be set forth in part in the following specification and in part will be obvious therefrom without being specifically referred to, the same being realized and attained as pointed out in the claims hereof.

The invention accordingly comprises the features of construction, combination of elements and arrangement of parts which will be exemplified in a construction hereinafter set forth and the scope of the application of which will be indicated in the claims.

BRIEF DESCRIPTION OF THE DRAWING

The invention will become more readily apparent from the following description of preferred embodiments thereof shown, by way of example, in the accompanying drawing, in which like reference characters will be used to denote the same or similar elements in order to aid in understanding the invention as the description proceeds and in which.

DESCRIPTION OF THE PREFERRED EMBODIMENTS

Figure 1:
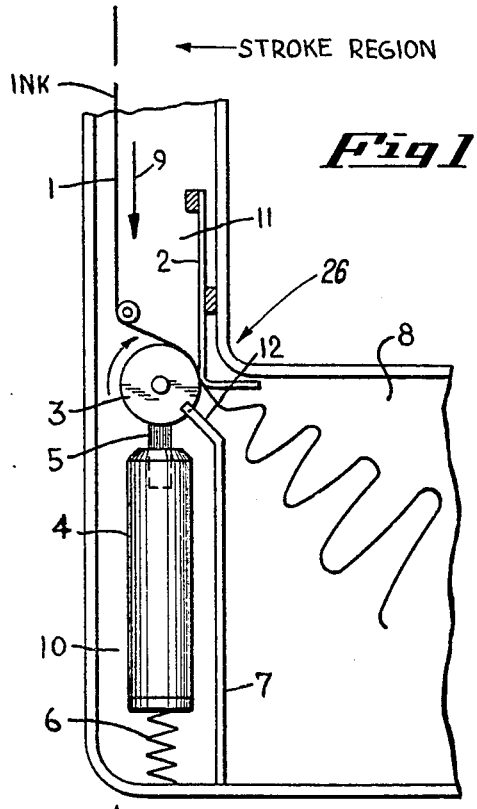
FIG. 1 is a fragmentary schematic plan view partially in section with the cover removed for one embodiment of the invention.

In carrying the invention into effect, several embodiments have been selected for illustration in the accompanying drawing and for description in the specification, reference being had to FIGS. 1 to 9.

FIGS. 1 to 6 show the following:

An endless dye impregnated ribbon, such as typewriter ribbon 1, moves through a passageway 11 defined in a cassette 26 in the direction of the arrow 9. A chamber 8 serves as a storage region for the ribbon 1 and a chamber 10 is used for re-impregnating means such as re-inking unit 4.

Transport means such as roller 3, is disposed between the chambers 8 and 10 and the passageway 11.

The re-inking unit 4 includes a capillary writing device such as a writing wick or felt tip 5 communicating with the dye or ink inside the re-inking unit 4 in order to carry the ink to the surface of the roller 3. A spring 6 urges the re-inking unit 4 towards the roller 3 to establish a firm contact therebetween. The ribbon 1 is pressed against the roller 3 by a spring 2 in order to assure the transfer of ink from the surface of the roller 3 onto the ribbon 1. The separating wall 7 between the chambers 8 and 10 has a tongue-like member 12 which serves as a stripping agent to separate the ribbon 1 from the roller 3.

Figure 2:
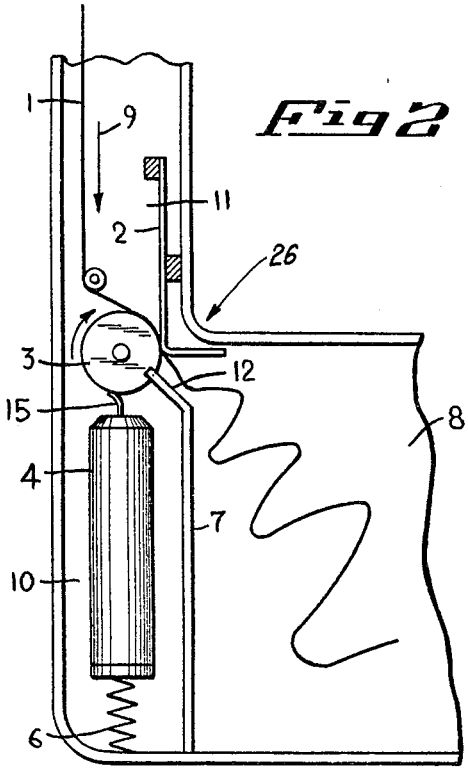
FIG. 2 is a fragmentary schematic plan view partly in section with the cover removed of another embodiment of the invention.

The embodiment shown in FIG. 2 is similar to the embodiment shown in FIG. 1, but uses a tongue-like member 15 in place of the felt tip 5. The tongue-like member 15 is shown in detail in FIGS. 5 and 6.

Figure 3:
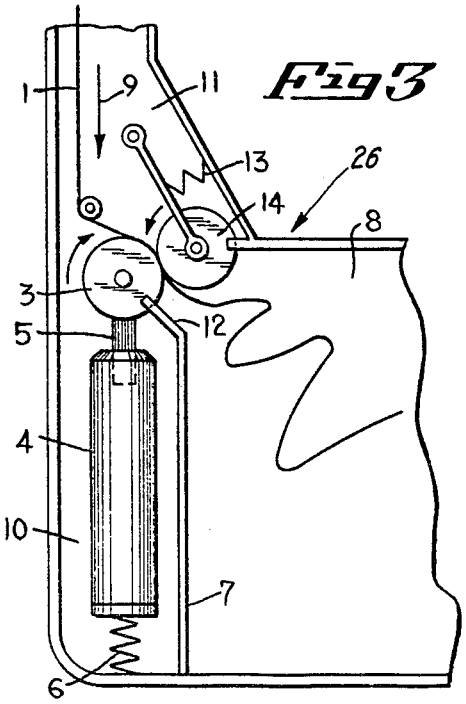
FIG. 3 is a fragmentary schematic plan view partly in section with the cover removed of a further embodiment of the invention.

The embodiment shown in FIG. 3 is similar to the embodiment shown in FIG. 1 in many of its features, but instead of the spring 2, there is a roller 14 urged against the ribbon 1 by a spring 13.

Figure 4:
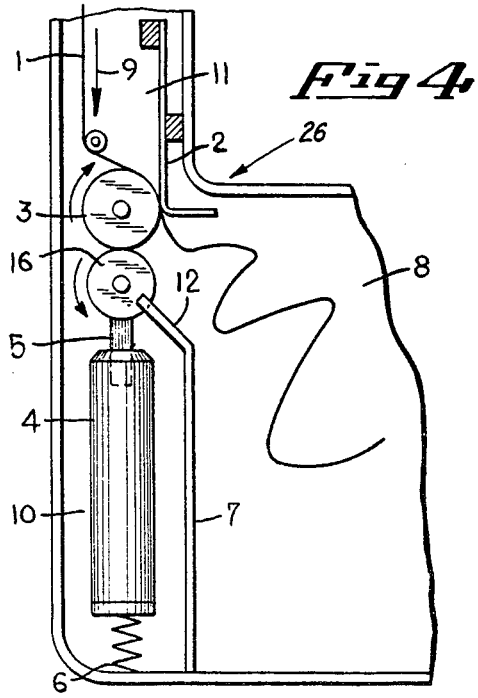
FIG. 4 is a fragmentary schematic plan view partly in section with the cover removed of yet another embodiment of the invention.
Figure 5:
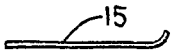
FIG. 5 is a side view of an element of FIG. 2.
Figure 6:
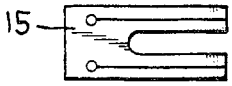
FIG. 6 is a top view of the element shown in FIG. 5.

The dye or ink transfer for FIG. 4 takes a form similar to that found in a multi-roller printing machine. A roller 16 contacts the felt tip 5 and carries the ink up to the roller 3. This arrangement has the advantage of obtaining a uniform distribution of the ink so that the re-inking of the ribbon 1 is uniform.

Figure 7A:
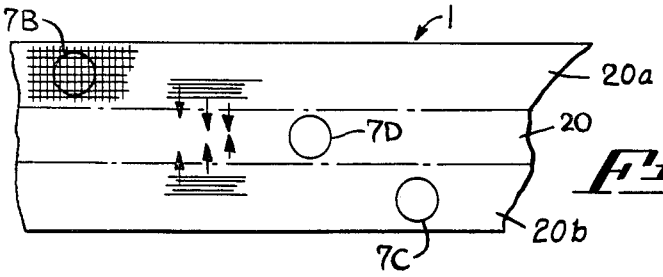
FIG. 7A is an enlarged fragmentary view of a portion of a ribbon which has been used for typing.
Figure 7B:
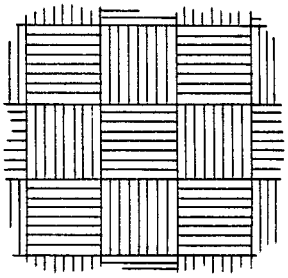
FIG. 7B is an enlarged view of the portion B in FIG. 7A.
Figure 7C:
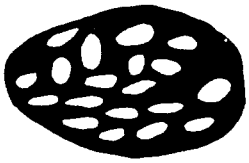
FIG. 7C is an enlarged view of the portion C in FIG. 7A.
Figure 7D:
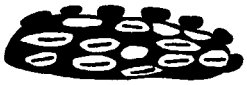
FIG. 7D is an enlarged view of the portion D in FIG. 7A.

FIG. 7A shows a typical typewriter ribbon 1. FIG. 7B is an enlargement of a portion of the ribbon 1 and shows details of the woven structure of the ribbon 1. FIGS. 7C and 7D are even greater enlargements of respective portions not typed on and typed on during the normal use of the ribbon 1.

Typically, the central portion 20 of the ribbon 1 becomes compressed from the type elements striking it and the spaces between fibers are diminished as shown in FIG. 7D with respect to the portion shown in FIG. 7C.

The physical distortions of the central portion 20 of the ribbon 1 significantly reduce the capability for re-inking that portion 20. This can make the ribbon 1 appear to be unusable because the poor capillary action inhibits the absorption of the ink.

In view of a study made, it was realized that a surprising improvement in re-inking could be obtained by re-inking portions 20*a* and 20*b* of the ribbon 1 adjacent to the central portion 20.

Figure 8:
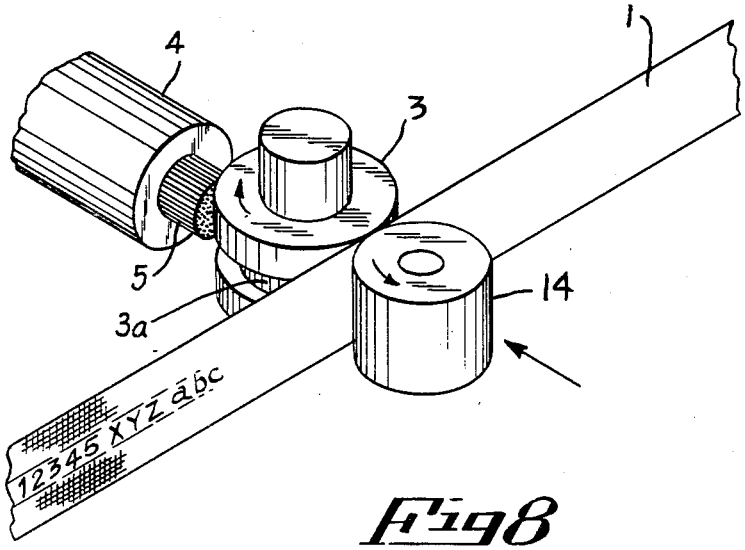
FIG. 8 is a fragmentary view of a portion of an embodiment according to the invention.

FIG. 8 shows an arrangement for carrying out this invention. The re-inking unit 4 includes a wick 5 and thereby communicates ink to a roller 3 which includes a central portion 3*a* out of contact with the wick 5. A pressure roller 14 is urged by a spring not shown to press against the ribbon 1. This arrangement results in the re-inking to be applied to the portions 20*a* and 20*b* of the ribbon 1 adjacent to the central portion 20 thereof. Capillary action carries the ink applied to the ribbon 1 to the central portion 20.

Figure 9:
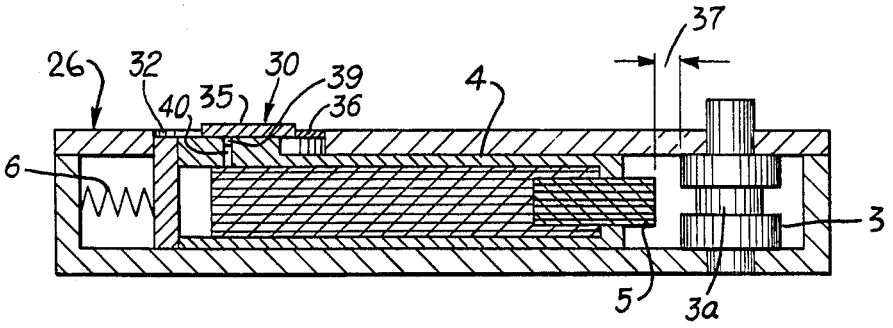
FIG. 9 is a sectional view taken on the line 9—9 of FIG. 10 with the locking feature in the locked position.
Figure 10:
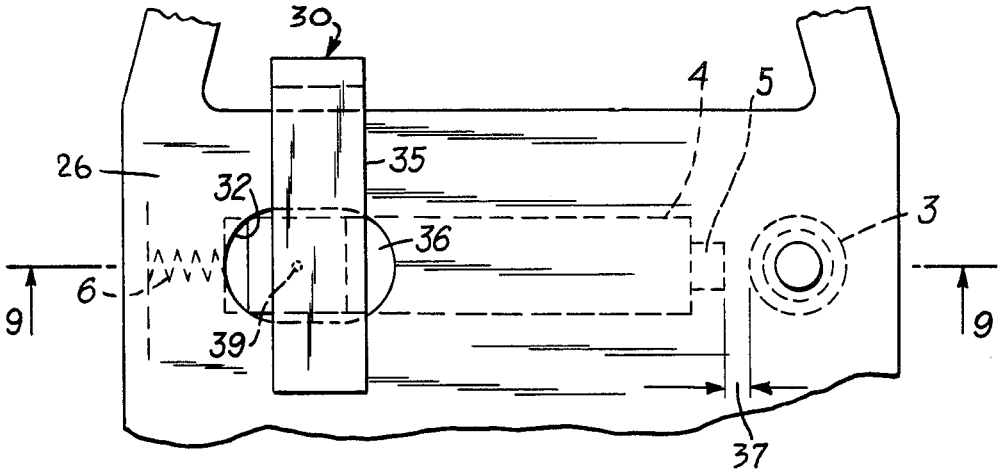
FIG. 10 is a fragmentary schematic plan view illustrating a feature of this invention.
Figure 11:
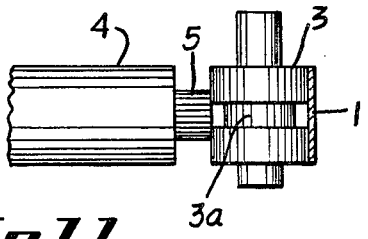
FIG. 11 is a fragmentary schematic side view of a portion of FIG. 8 with the invention in its active mode.

FIGS. 9 to 11 show the following:

The cassette 26 includes a re-inking unit 4 urged by a spring 6 to bring its writing wick or felt tip 5 in contact with the roller 3.

An aperture 32 is defined in the cassette 26 and there is a locking means 30 closing off at least a portion of the aperture 32 to inhibit the entry of foreign matter through the aperture 32. In addition, the locking means 30 includes a locking key 35 which has a portion 36 provided with a pin 39, engageable in an aperture 40 in the unit 4, which restrains the movement of the re-inking unit 4 towards the roller 3 and thereby maintains them spaced apart by space 37.

Figure 9A:
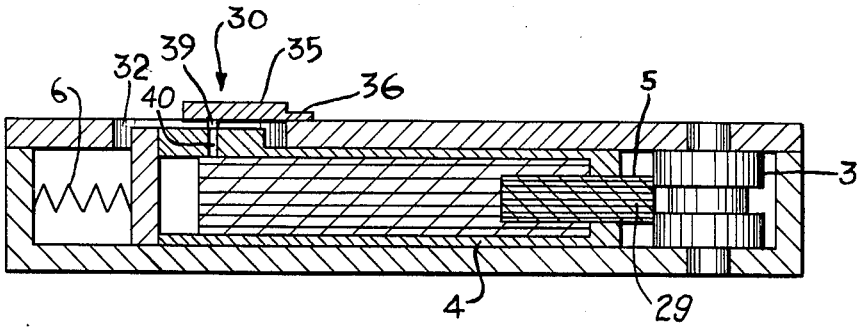
FIG. 9A corresponds to FIG. 9, but with the locking feature in the unlocked position.

The removal of the locking means 30 from the position shown in FIG. 9 to the position shown in FIG. 9A allows the re-inking unit 4 to move to its active position in contact with the roller 3. Once activated, the re-inking unit 4 in cooperation with the roller 3, can re-ink the ribbon 1.

OPERATION

Generally, the ribbon 1 moves through the passageway 11 in the direction of the arrow 9 from a stroke region defined by the typewriter (not shown in the drawing). The ribbon 1 is moved by the transport means into the storage region defined by the chamber 8. Just before the ribbon 1 moves into the chamber 8, it is re-inked by the re-impregnating means which cooperates with the transport means. The ribbon 1 leaves the chamber 8 and moves to the stroke region and continues the cycle.

The ribbon 1 can be composed of a textile material saturated with a liquid typewriter ribbon ink as well as a plastic carbon ribbon having a non-illustrated sponge-like ink releasing coating. In addition, the re-inking units can be exchangeable, and it is possible to arrange two cartridges, one on top of another, for two colored typewriter ribbons.

The use of the locking means 30 with the cassette 26 maintains the re-inking unit 4 spaced apart from the ribbon 1 and generally prevents the entry of foreign matter into the cassette 26 as shown in FIG. 9. Removal of the locking means 30 activates the re-inking unit 4 and allows the cassette 26 to be utilized in a normal operation, as shown in FIGS. 9A and 11.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. An ink ribbon cassette, for use in connection with a device, such as a typewriter, for printing characters on a surface from the stroke impact of a dye impregnated ribbon, said ribbon having a compressible center region, and two outer regions bounding said center region, comprising in combination:

a housing defining an aperture for ventilating a chamber defined therein;

re-impregnating means disposed in said chamber and operable for re-impregnating said ribbon with dye, when in an operating position;

locking means mounted on, and movable with said re-impregnating means, and also removably engageable with an edge of said aperture and operable to lock said re-impregnating means in a deactivated position against the bias of a spring during engagement of said locking means with said aperture; and dye transfer means cooperating with said re-impregnating means when said re-impregnating means is in the operating position for transferring dye to said ribbon, said dye transfer means comprising a pair of outer transfer portions and an intermediate recessed portion, said outer transfer portions contacting said re-impregnating means in the operating position thereof for transferring dye to the outer regions of said ribbon by said outer transfer portions, the compressible center region of said ribbon remaining free of any contact with the intermediate recessed portion of said dye transfer means, whereby said compressible center region of said ribbon receives the dye by capillary action from the outer regions of said ribbon.

2. The cassette as claimed in claim 1, wherein said locking means closes at least a portion of said aperture.

3. A cassette as claimed in claim 1, wherein said re-impregnating means comprises a device urged to a feeding position for re-impregnating said ribbon and said locking means when in said engaged position maintains said device deactivated, by blocking the movement of said device to said feeding position.

4. An inked ribbon cassette, for use in connection with a device, such as a typewriter, for printing characters on a surface from the stroke impact of an endless dye impregnated ribbon, said ribbon having a compressible center region, and two outer regions bounding said center region, said device defining a stroke region, comprising in combination:

a housing defining two chambers, one of said chambers providing a storage region, said housing having a passageway for said ribbon, said passageway intercommunicating with said storage region and communicating with said stroke region to move between said stroke region and said storage region;

re-impregnating means disposed in the other chamber and operable for re-impregnating said ribbon with dye when in an operating position;

transport means disposed substantially between said chambers and said passageway and operable for transporting said ribbon to move between said stroke region and said storage region and for maintaining said ribbon substantially stretched in said stroke region;

said housing defining an aperture communicating with said other chamber;

locking means mounted on and movable with said re-impregnating means, and also removably engaged with said aperture and operable to lock said re-impregnating means in a deactivated position against the bias of a spring during engagement of said locking means with said aperture, and dye transfer means cooperating with said re-impregnating means when said re-impregnating means is in the operating position for transferring dye to said ribbon, said dye transfer means comprising a pair of outer transfer portions and an intermediate recessed portion, said outer transfer portions contacting said re-impregnating means in the operating position thereof for transferring dye to the outer regions of said ribbon by said outer transfer portions, the compressible center region of said ribbon remaining free of any contact with the intermediate recessed portion of said dye transfer means, whereby said compressible center region of said ribbon receives the dye by capillary action from the outer regions of said ribbon.

* * * * *